US009829905B2

(12) United States Patent
Mitchell et al.

(10) Patent No.: US 9,829,905 B2
(45) Date of Patent: Nov. 28, 2017

(54) METHODS AND APPARATUS FOR BALANCING CURRENT ACROSS PARALLEL LOADS

(71) Applicant: GM GLOBAL TECHNOLOGY OPERATIONS LLC, Detroit, MI (US)

(72) Inventors: Gary K. Mitchell, Kokomo, IN (US); Mark B. Kearney, Kokomo, IN (US); William Parker Whitlock, Cicero, IN (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 145 days.

(21) Appl. No.: 15/055,067

(22) Filed: Feb. 26, 2016

(65) Prior Publication Data

US 2017/0248983 A1 Aug. 31, 2017

(51) Int. Cl.
*G05F 3/02* (2006.01)
*G05F 3/26* (2006.01)

(52) U.S. Cl.
CPC ..... *G05F 3/26* (2013.01)

(58) Field of Classification Search
CPC ..... G05F 3/02; G05F 3/26
See application file for complete search history.

(56) References Cited

U.S. PATENT DOCUMENTS 8,188,617 B2 * 5/2012 Kimura ..... H05B 33/0815 307/32
8,829,884 B2 9/2014 Zhong et al.
8,981,666 B2 * 3/2015 Yu ..... G09G 3/3406 315/291
2012/0306387 A1 12/2012 Ferguson

* cited by examiner

*Primary Examiner* — Hai L Nguyen
(74) *Attorney, Agent, or Firm* — Lorenz & Kopf, LLP

(57) ABSTRACT

A system for balancing current in a circuit is provided. Embodiments of the system include: a plurality of parallel load paths of the circuit, each of the plurality of parallel load paths comprising a single load or a plurality of loads connected in series; a current source electrically connected to the circuit, the current source configured to provide a constant current to the plurality of parallel load paths, the current comprising the constant current; a plurality of bipolar transistors, each of the plurality of bipolar transistors electrically connected in series to one of the plurality of parallel load paths, and each of the plurality of bipolar transistors comprising a base, an emitter, and a collector; a plurality of emitter resistors, each of the plurality of emitter resistors electrically connected to a respective emitter of an associated one of the plurality of bipolar transistors; a plurality of base resistors, each of the plurality of base resistors electrically connected to a respective one of the plurality of bipolar transistors to create a connection, wherein the connection electrically connects a base and a collector of one of the plurality of bipolar transistors; and a common base node electrically connecting each of the bases of each of the plurality of bipolar transistors.

20 Claims, 9 Drawing Sheets

METHODS AND APPARATUS FOR BALANCING CURRENT ACROSS PARALLEL LOADS

TECHNICAL FIELD

Embodiments of the subject matter described herein relate generally to current-balancing circuits. More particularly, embodiments of the subject matter relate to balancing current across multiple parallel loads in a circuit.

BACKGROUND

Implementing a current source for a particular circuit may present challenges. The implementation of a current source can often include large, complex, and costly components such as power transistors, power inductors, and controller integrated circuits (ICs). In addition, high frequency switching is often involved, which has the potential to create unwanted electromagnetic interference (EMI) side effects which must be mitigated through additional shielding or filtering. Therefore, implementing a minimum number of current sources in a given design is beneficial as it may help minimize overall cost and complexity of the system. Thus, when multiple loads in a system are required to be driven with constant currents, a designer might employ a current mirror in order to share one current source between two or more loads.

One application of this concept is in new exterior light emitting diode (LED) lighting products that are using increasing numbers of discrete LEDs to create unique styling features that distinguish each vehicle as being unique. However, as the number of LEDs increase, figuring out an effective and cost effective method to drive them and have a uniform appearance is becoming a challenge. If all LEDs are placed in a series configuration, the drive voltage required to feed the LEDs exceeds practical limits of IC process capability. If one begins to divide them into parallel strings, it is difficult to ensure that each LED receives the same amount of current. Unequal currents will result in differences in either or both color or intensity, which could cause customer dissatisfaction as well as regulatory compliance concerns.

Accordingly, it is desirable to provide a solution to which could balance currents in multiple loads given a single constant current source. Furthermore, other desirable features and characteristics will become apparent from the subsequent detailed description and the appended claims, taken in conjunction with the accompanying drawings and the foregoing technical field and background.

BRIEF SUMMARY

Embodiments of the present disclosure provide a system for balancing current in a circuit. The system includes a plurality of parallel load paths of the circuit, each of the plurality of parallel load paths comprising a single load or a plurality of loads connected in series; a current source electrically connected to the circuit, the current source configured to provide a constant current to the plurality of parallel load paths, the current comprising the constant current; a plurality of bipolar transistors, each of the plurality of bipolar transistors electrically connected in series to one of the plurality of parallel load paths, and each of the plurality of bipolar transistors comprising a base, an emitter, and a collector; a plurality of emitter resistors, each of the plurality of emitter resistors electrically connected to a respective emitter of an associated one of the plurality of bipolar transistors; a plurality of base resistors, each of the plurality of base resistors electrically connected to a respective one of the plurality of bipolar transistors to create a connection, wherein the connection electrically connects a base and a collector of one of the plurality of bipolar transistors; and a common base node electrically connecting each of the bases of each of the plurality of bipolar transistors.

Some embodiments of the present disclosure provide a current-balancing circuit. The current-balancing circuit includes a plurality of parallel load paths electrically connected to a constant source of current, each of the plurality of parallel load paths comprising a single load or a plurality of loads connected in series; and a current mirror configured to balance the current in the plurality of parallel load paths, the current mirror comprising: a plurality of field effect transistors (FETs), wherein each of the plurality of FETs is electrically connected to a respective one of the plurality of parallel load paths, wherein each of the plurality of FETs comprises a gate, an source, and a drain, and wherein a plurality of gates of the plurality of transistors is electrically connected to create a common gate node; a plurality of gate resistors, each of the plurality of gate resistors electrically connecting a drain and a gate of a respective one of the plurality of FETs; and a control node, electrically connecting the plurality of gate resistors, the control node configured to be driven by an average voltage of the plurality of loads.

Some embodiments of the present disclosure provide A current-balancing circuit comprising: a plurality of parallel load paths electrically connected to a constant source of current, each of the plurality of parallel load paths comprising a single load or a plurality of loads connected in series; a current mirror configured to balance the current in the plurality of parallel load paths, the current mirror comprising: a plurality of bipolar transistors, wherein each of the plurality of transistors is electrically connected to a respective one of the plurality of parallel load paths, wherein each of the plurality of transistors comprises a base, an emitter, and a collector, and wherein a plurality of bases of the plurality of transistors is electrically connected to create a common base node; a plurality of base resistors, each of the plurality of base resistors electrically connecting a collector and a base of a respective one of the plurality of transistors; and a control node, electrically connecting the plurality of base resistors, the control node configured to be driven by an average voltage of the plurality of loads; and at least one processor electrically connected to each of the plurality of parallel loads, the at least one processor configured to: identify a threshold voltage at which performance deterioration of the plurality of transistors occurs; detect a voltage across the plurality of transistors; compare the voltage to the threshold voltage; and when the voltage is greater than the threshold voltage, reduce output of the constant source of current.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The subject matter presented herein relates to a system for balancing current provided to a circuit that includes a plurality of parallel loads. In certain embodiments, the system includes one or more enhanced current mirrors that include: transistors, base resistors, emitter resistors, a common base node, and/or a control node, configured to balance, or in other words, to "equalize", the current flowing through each of the plurality of parallel loads.

Figure 1:
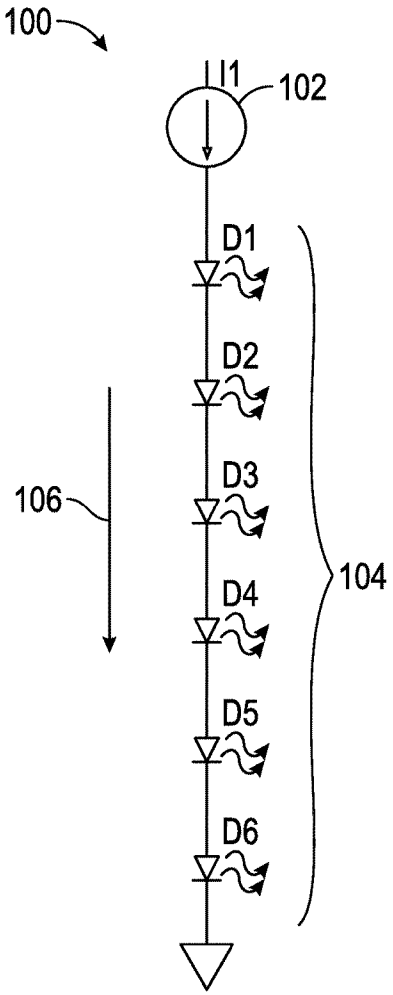
FIG. 1 is a circuit including a plurality of loads connected in series, in accordance with the disclosed embodiments.

Turning now to the figures, FIG. 1 illustrates a circuit 100 that includes a plurality of loads connected in series, in accordance with the disclosed embodiments. In the circuit 100, a plurality of loads 104 is connected in series, and a power supply 102 provides a constant current to each of the loads 104 in the circuit 100. Here, the circuit 100 is implemented using a series circuit, or in other words, a closed circuit in which the current follows one current path 106. In the example shown, the plurality of loads 104 is implemented using light emitting diodes (LEDs). However, it should be appreciated that other embodiments may use any type of load connected using a series circuit. Because the circuit 100 is a series circuit with a single current path 106, the current value is the same at every location in the circuit 100, and each LED receives the same amount of current, thereby producing illumination of similar brightness and/or color.

Figure 2:
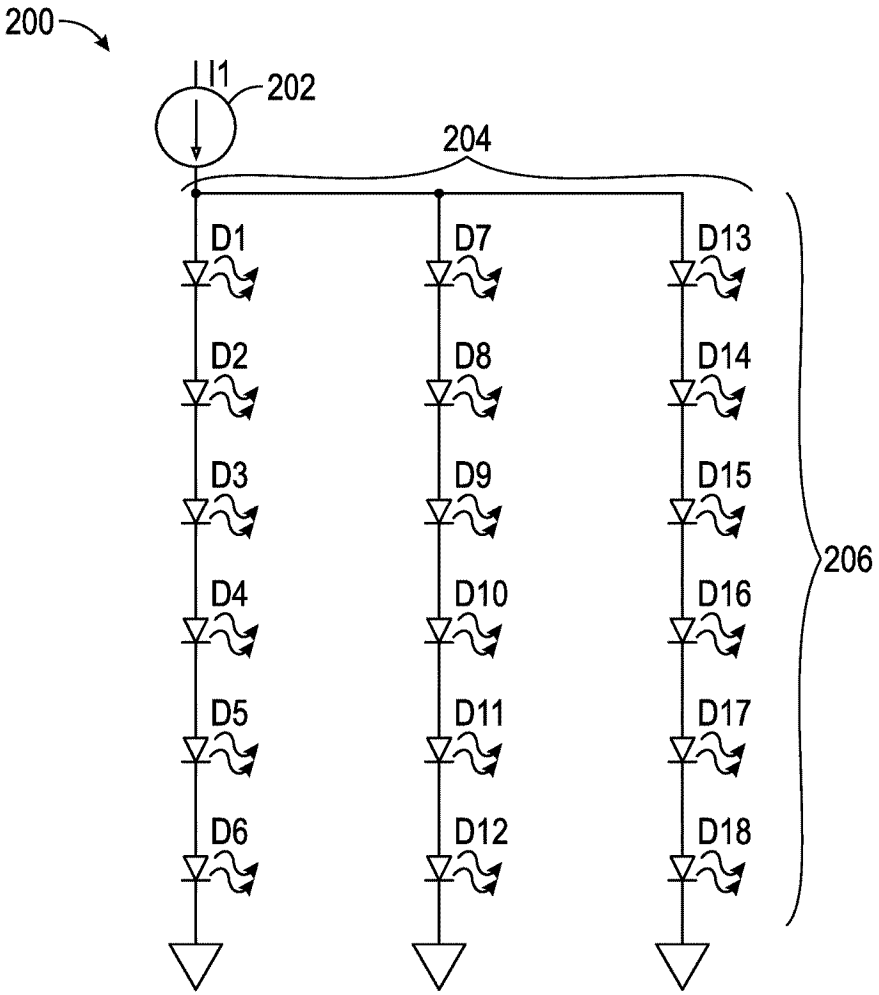
FIG. 2 is a circuit including a plurality of parallel load paths, in accordance with the disclosed embodiments.

FIG. 2 illustrates a circuit 200 that includes a plurality of parallel load paths 204, in accordance with the disclosed embodiments. Each parallel load path 204 is similar to that shown in FIG. 1 (see reference 104). As shown, each parallel load path 204 includes a plurality of loads 206 connected in series, and a power supply 202 provides a constant current to each of the parallel load paths 204 in the circuit 200. Here, each of the parallel load paths 204 is implemented using a series circuit, described above with regard to FIG. 1. Similar to FIG. 1, this example illustrates a plurality of loads 206, associated with each parallel load path 204, and implemented using light emitting diodes (LEDs).

In the exemplary embodiment shown, each parallel load path 204 of LEDs operates in conjunction with the other parallel load paths 204 of LEDs to provide illumination for an LED light fixture. However, it should be appreciated that other embodiments may use any type of load connected using a plurality of series circuits electrically connected in parallel. Each of the parallel load paths 204 shown is a series circuit with a single current path, and the current value is the same at every location in the series circuit. However, the parallel load paths 204 (i.e., the series circuits) are connected in parallel, and each of the parallel load paths 204 may have a different current value, due to potentially differing voltage values associated with each parallel load path 204. In the exemplary embodiments shown, potentially different current values at each of the parallel load paths 204 may cause the LEDs to produce different visual effects, to include without limitation, different levels of brightness and/or different colors of light.

Figure 3:
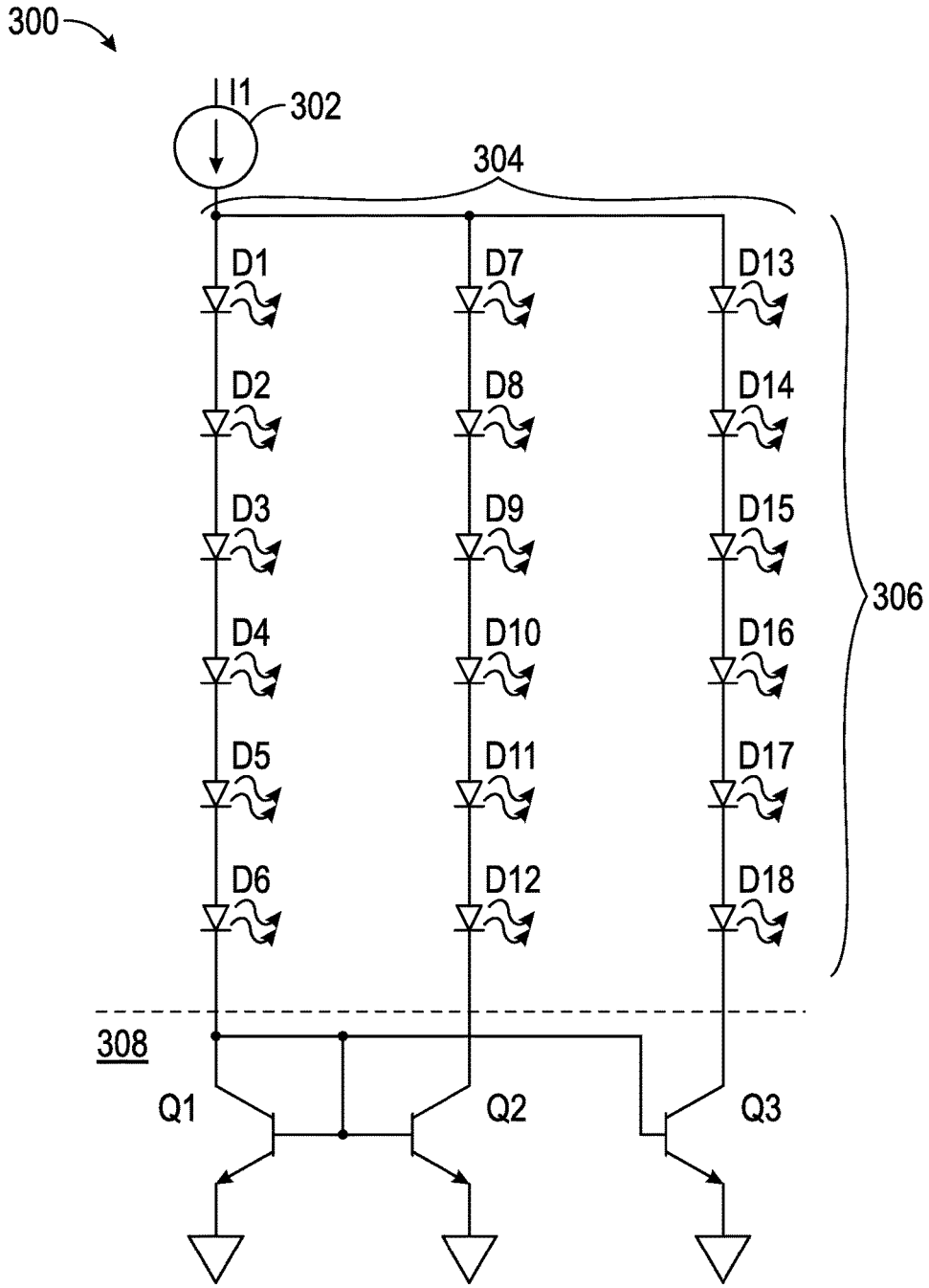
FIG. 3 is a circuit including a traditional current mirror, in accordance with the disclosed embodiments.

Each parallel load path of LEDs may be configured to produce the same visual effects by balancing the current such that approximately equivalent current values flow through each parallel load path 204. One such configuration of circuitry which may be used to balance the current at each parallel load path 204 is shown in FIG. 3, which is a circuit 300 that includes a traditional current mirror 308, in accordance with the disclosed embodiments. Like the circuit shown in FIG. 2, the circuit 300 includes a plurality of parallel load paths 304, and each of the parallel load paths 304 includes a plurality of loads 306. The circuit 300 is also electrically connected to a power supply which provides a constant source of current to the circuit 300. The current mirror 308 is electrically connected to the plurality of parallel load paths 304, and includes a plurality of transistors. In this particular example, each of the plurality of parallel load paths 304 is electrically connected to the collector of a transistor, and the emitter of each of the transistors is electrically connected to circuit ground. Additionally, the base of each transistor is connected via a common base node.

A common method for balancing or "equalizing" the current in multiple parallel load paths 304 is the use of the common current mirror 308. In this approach, it is assumed that if the transistors are similar and have identical base-emitter voltages, each will conduct a similar current. In this circuit, transistor Q1 has a short between its base and collector terminals and becomes the independent "control" device of the mirror, and transistors Q2 and Q3 become the dependent devices of the current mirror 308, attempting to sink a current equal to the current flowing into the collector of Q1. This approach works fairly well as long as the voltage drops of String 2 and String 3 are not substantially higher than the voltage drop of String 1, which serves as the control path. If the voltage drop in either String 2 or String 3 gets too large, the respective dependent transistor driving that string will begin to saturate, limiting the current in that string and causing an imbalance in the shared current in the plurality of parallel load paths 304.

Other techniques (using the current mirror 308) may be used to improve the current balance in the plurality of parallel load paths 304. However, these techniques tend to increase cost and complexity of the circuit 300. A low-cost, low-complexity solution to current-balancing for a plurality of parallel load paths 304 is described with reference to FIG. 5, below.

Figure 4:
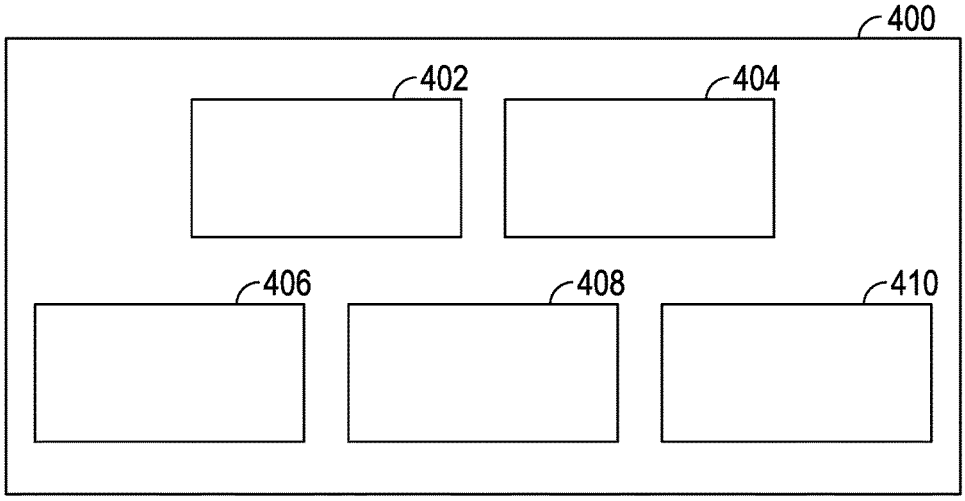
FIG. 4 is a functional block diagram of a current-balancing system, in accordance with the disclosed embodiments.

FIG. 4 is a functional block diagram of a current-balancing system 400, in accordance with the disclosed embodiments. It should be appreciated that the current-balancing system 400 represents a "full featured" embodiment that supports various features described herein. In practice, an implementation of the current-balancing system 400 need not support all of the enhanced features described here and, therefore, one or more of the elements depicted in FIG. 4 may be omitted from other embodiments. Moreover, other implementations of the current-balancing system 400 may include additional elements and features that support conventional functions and operations.

The current-balancing system 400 generally includes, without limitation: at least one processor 402; system memory 404; current-balancing circuitry 406; a voltage analysis module 408; and a current adjustment module 410. These elements and features of current-balancing system 400 may be operatively associated with one another, coupled to one another, or otherwise configured to cooperate with one another as needed to support the desired functionality, as described herein. For ease of illustration and clarity, the various physical, electrical, and logical couplings and interconnections for these elements and features are not depicted in FIG. 4. Moreover, it should be appreciated that embodiments of the current-balancing system 400 will include other elements, modules, and features that cooperate to support the desired functionality. For simplicity, FIG. 4 only depicts certain elements that relate to the current-balancing techniques described in more detail below.

The optional at least one processor 402 may be implemented or performed with one or more general purpose processors, a content addressable memory, a digital signal processor, an application specific integrated circuit, a field programmable gate array, any suitable programmable logic device, discrete gate or transistor logic, discrete hardware components, or any combination designed to perform the functions described here. In particular, the at least one processor 402 may be realized as one or more microprocessors, controllers, microcontrollers, or state machines. Moreover, the at least one processor 402 may be implemented as a combination of computing devices, e.g., a combination of digital signal processors and microprocessors, a plurality of microprocessors, one or more microprocessors in conjunction with a digital signal processor core, or any other such configuration.

The optional system memory 404 may be realized using any number of devices, components, or modules, as appropriate to the embodiment. Moreover, the at least one processor 402 could include system memory 404 integrated therein and/or system memory 404 operatively coupled thereto, as appropriate to the particular embodiment. In practice, the system memory 404 could be realized as RAM memory, flash memory, EPROM memory, EEPROM memory, registers, a hard disk, a removable disk, or any other form of storage medium known in the art. The system memory 404 can be coupled to the at least one processor 402 such that the at least one processor 402 can read information from, and write information to, the system memory 404. In the alternative, the system memory 404 may be integral to the at least one processor 402. As an example, the at least one processor 402 and the system memory 404 may reside in a suitably designed application-specific integrated circuit (ASIC).

The current-balancing circuitry 406 may include any circuitry appropriate for balancing or "equalizing" current flow among a plurality of parallel load paths. The current-balancing circuitry 406 includes at least one load for each of the plurality of parallel load paths. In the context of the present disclosure, a load may be defined as an electrical component or portion of a circuit that consumes electric power. In certain embodiments, the loads may be implemented using light emitting diodes (LEDs). However, other embodiments may include any load appropriate to a parallel circuit configuration. The current-balancing circuitry 406 is suitably configured to balance the current flow among the plurality of parallel loads such that the current flow through each parallel string is equal or similar or proportional to another load. The current-balancing circuitry 406 includes one or more current mirrors configured for this purpose. Exemplary embodiments of the current-balancing circuitry 406 are described in more detail below with regard to FIGS. 5-9.

The optional voltage analysis module 408 is configured to detect a voltage across the transistors of the one or more current mirrors of the current-balancing circuitry 406. The voltage analysis module 408 is further configured to compare the detected voltage to a maximum allowable voltage threshold, in order to determine whether additional action is required to prevent the transistors from overheating. This situation may occur when the each of the parallel loads are not balanced, or in other words, the parallel loads are not identical, due to power that must be dissipated in the transistors as the loads become more different.

The optional current adjustment module 410 is configured to adjust output of a current source electrically connected to the current-balancing circuitry 406, in response to the assessment of the voltage analysis module 408. The current adjustment module 410 may reduce and/or deactivate current flow provided by the current source when the voltage analysis module 408 determines that a detected transistor voltage exceeds the predetermined, maximum allowable voltage threshold.

In practice, the voltage analysis module 408 and/or the current adjustment module 410 may be implemented with (or cooperate with) the at least one processor 402 to perform at least some of the functions and operations described in more detail herein. In this regard, the voltage analysis module 408 and/or the current adjustment module 410 may be realized as suitably written processing logic, application program code, or the like.

Figure 5:
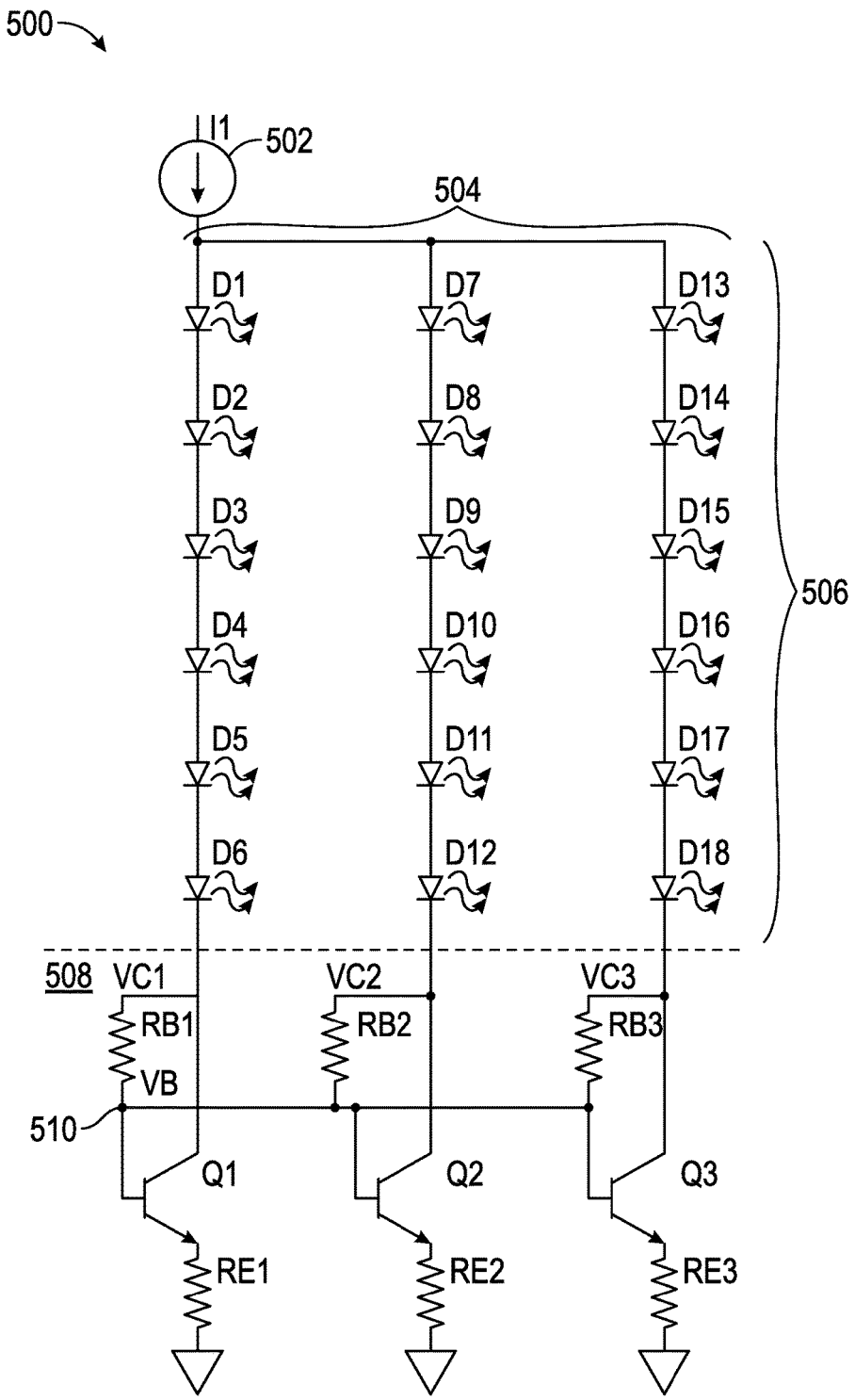
FIG. 5 is a circuit for balancing currents in parallel load paths, in accordance with the disclosed embodiments.

FIG. 5 is a circuit 500 for balancing currents in parallel load paths, in accordance with the disclosed embodiments. It should be appreciated that FIG. 5 depicts a simplified embodiment of the circuit 500, and that some embodiments of the circuit 500 may include additional elements or components. In particular, any number of loads and/or parallel load paths may be used. The circuit 500 is similar to that described above with regard to FIG. 3, in that the circuit 500 includes a plurality of parallel load paths 504, and each of the plurality of parallel load paths 504 include a plurality of loads 506. Each of the plurality of loads may be implemented as a light emitting diode (LED), as shown in the exemplary embodiment of the circuit 500, or any other type of load appropriate for use in parallel load paths 504. Also similar to the circuit described above with regard to FIG. 3, the circuit 500 is electrically connected to a power supply 502, which provides a constant current to the circuit 500.

However, the circuit 500 differs from the circuit of FIG. 3 in that the circuit 500 includes an enhanced current mirror 508. The enhanced current mirror 508 includes a plurality of transistors, each of the plurality of transistors electrically connected in series to one of the plurality of parallel load paths. Each of the plurality of transistors includes a base, an emitter, and a collector. Each transistor is electrically connected to an emitter resistor at the transistor emitter. Each transistor is also electrically connected to a base resistor, which electrically creates an electrical connection from the base to the collector of an individual one of the plurality of transistors in the current mirror. In certain embodiments, each base resistor comprises an equivalent resistance value. Each base of the transistors of the enhanced current mirror 508 is electrically connected to the other bases of the transistors of the enhanced current mirror 508 via a common base node 510.

The enhanced current mirror 508 functions to provide a low cost solution to balancing currents in parallel load paths. This circuit 500 effectively "averages" the difference in voltage drops across the plurality of parallel load paths 504 to drive a "control" node of the enhanced current mirror 508. Since the control node is driven by the average voltage of all the loads, no specific load serves as the controlling path and a selection circuit is not required. While this may somewhat limit the total range in different load voltages that may be balanced, the circuit 500 is simple and may be extended to applications utilizing several parallel loads. The circuit 500 also has fast transient response since no load selection circuitry is required.

In the circuit 500, NPN transistors Q1, Q2, and Q3 have a common base connection with equal value resistors RE1, RE2, and RE3 from their respective emitters to circuit ground. Once sufficient voltage is reached at the common base node VB 510, the three transistors will conduct substantially equal currents as long as none of the three go into collector-emitter saturation. If the currents in each of the transistors are equal, we assume that the current in each of the load paths settles at one third of the current supplied by constant current source 502. Equal value resistors RB1, RB2, and RB3 connect from the collectors of each of the transistors to drive node VB 510 to the "average" of the three collector voltages VC1, VC2, and VC3 which settles at a base-emitter diode drop above the emitter voltages. Since the base currents of the three transistors are provided by resistors RB1, RB2, and RB3, their value must be kept low enough to prevent excessive voltage drop from the collector voltages to VB. As the value of the RB resistors (e.g., RB1, RB2, RB3) is lowered, however, the imbalance in load currents with respect to differing load voltages increases due to the differing currents in each of the RB resistors.

Figure 6:
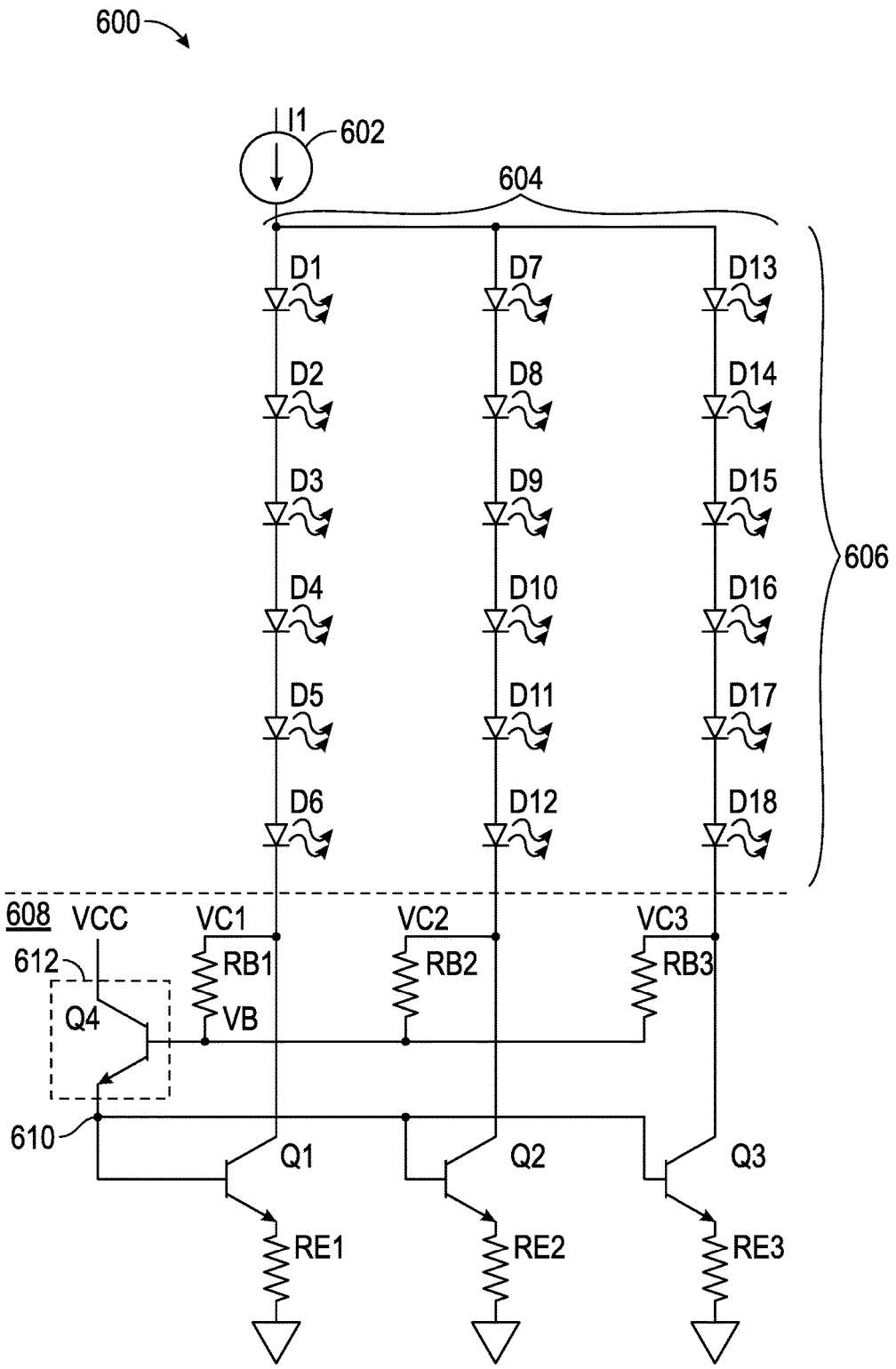
FIG. 6 is another circuit for balancing currents in parallel load paths, in accordance with the disclosed embodiments.

FIG. 6 is another circuit 600 for balancing currents in parallel load paths, in accordance with the disclosed embodiments. The circuit 600 is similar to that described above with regard to FIG. 5. The circuit 600 includes a plurality of parallel load paths 604, and the circuit 600 is electrically connected to a power supply 602, which provides a constant current to the circuit 600. The circuit 600 also includes an enhanced current mirror 608, with a configuration similar to the enhanced current mirror of FIG. 5. However, the enhanced current mirror 608 includes a "beta helper" transistor 612, electrically connected to each of the plurality of base resistors at a base of the beta helper transistor 612. The emitter of the beta helper transistor 612 is also electrically connected to a base of each of the other transistors, via a common base node 610.

The basic three LED string circuit is shown in FIG. 6. Transistors Q1, Q2, and Q3 each drive the plurality of parallel load paths 604 (e.g., LED strings, as shown), driven from a constant current driver source represented by the power supply 602, which sources three times the LED current desired for each string ($3\times I_{load}$). Current sourced from the power supply 602 causes the lower ends of the plurality of parallel load paths 604 to rise in voltage, raising the voltage at the base of the beta helper transistor 612 and, subsequently, the voltage at the bases of Q1, Q2, and Q3. Once Q1, Q2, and Q3 turn on enough to sink the total current supplied by the power supply 602, the circuit 600 achieves balance.

In the exemplary embodiment shown, Q1, Q2, and Q3 are similar transistors with nearly equal base-emitter voltage drops, and resistors RE1, RE2, and RE3 are equal value (within tolerance), thus rendering the collector currents in Q1, Q2, and Q3 nearly equal. This result is maintained even if the voltage drops across the plurality of parallel load paths 604 are different, as long as transistors Q1, Q2, and Q3 maintain a state outside of saturation, and as long as transistors Q1, Q2, and Q3 are operating at substantially similar temperatures.

The beta helper transistor 612 allows the base currents for Q1, Q2, and Q3 to be supplied from Vcc. The base of the beta helper transistor 612 is driven from resistors RB1, RB2, and RB3, and the voltage at the base of the beta helper transistor 612 is essentially the average of the collector voltages of Q1, Q2, and Q3. Assuming the power supply 602 supplies a current of three times the LED current desired for each of the plurality of parallel load paths 604 ($3\times I_{load}$) and the current splits evenly, the voltage at the emitters of Q1, Q2, and Q3 is the current desired for each of the plurality of parallel load paths times the emitter resistance value ($I_{load}\times$ Re). The voltage at the bases of Q1, Q2, and Q3 is approximately 0.7 Volts (V) higher than the emitter voltages, and the voltage at the base of the beta helper transistor 612 is another 0.7V higher than the voltage at the bases of Q1, Q2, and Q3. Thus, the voltage at the base of the beta helper transistor 612 is approximately 1.4V above the emitter voltages set by $I_{load}\times$Re.

The circuit is similar to a standard NPN current "mirror" (see FIG. 3, reference 308) with the exception that the base of the beta helper transistor 612 is driven by the average of the three collector voltages instead of just one. This allows any voltage difference between the plurality of parallel load paths 604 (e.g., the three LED strings shown) to be "shared" by the circuit 600, lowering the voltage headroom required by the circuit 600 somewhat over a standard current mirror.

The circuit shown in FIG. 5 is improved as shown in FIG. 6 with the addition of the beta helper transistor 612. This allows the values of resistors RB1, RB2 & RB3 to be much larger than is practical in the previous circuit since the added beta helper transistor 612 provides the base drives for the three mirror transistors from a separate supply. This implementation also has the advantage that the average node VB now biases at two diode drops higher than the emitter voltages of the enhanced current mirror 608 transistors which allows additional voltage difference between the loads before an enhanced current mirror 608 transistor approaches collector-emitter saturation. The addition of the beta helper transistor 612 also allows the approach to be easily extended to several additional parallel load paths if desired.

The resistors RE1, RE2, and RE3 in the emitter paths of the enhanced current mirror 608 transistors Q1, Q2, and Q3 help minimize the effects of manufacturing differences in the enhanced current mirror 608 transistors when discrete transistors are used which may have minor differences in base-emitter diode voltages. It is also important to manage junction temperature differences in these transistors which can be caused by differences in dissipated power as the load voltages vary between devices. Using device packages with relatively low thermal resistance to a common heat spreader on a printed circuit board (PCB) can be effective in minimizing thermal differences between the enhanced current mirror 608 transistors.

Although this circuit was developed for use in LED lighting systems, it can easily be applied to any application where balanced currents in similar parallel loads are desired. A further extension of the invention would be to incorporate different values of the Re emitter resistors to achieve non-equal ratios of the load currents if desired, allowing the supplied load current to be split in controlled ratios among the different parallel load paths.

The circuit 600 is designed to be placed between the low side of the parallel loads and the circuit ground, but a complementary circuit constructed of PNP transistors could be easily configured in a like manner to provide current balancing on the high side of a similar plurality of parallel load paths 604. Also, the approach is not limited to bipolar transistors and could easily be applied to applications using FETs or other potential control elements.

Figure 7:
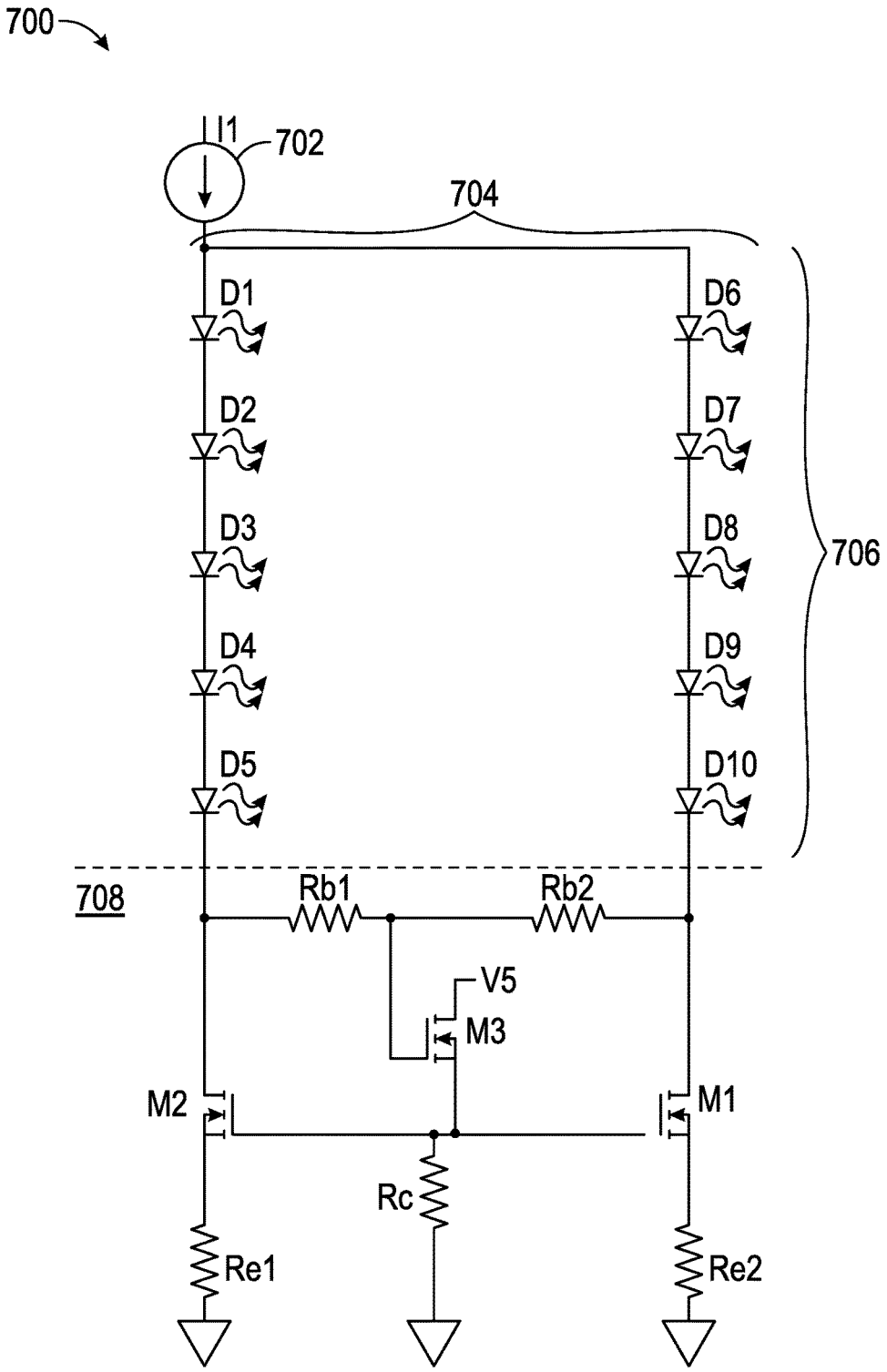
FIG. 7 is a circuit for balancing currents in parallel load paths using Field Effect Transistors (FETs), in accordance with the disclosed embodiments.
Figure 8:
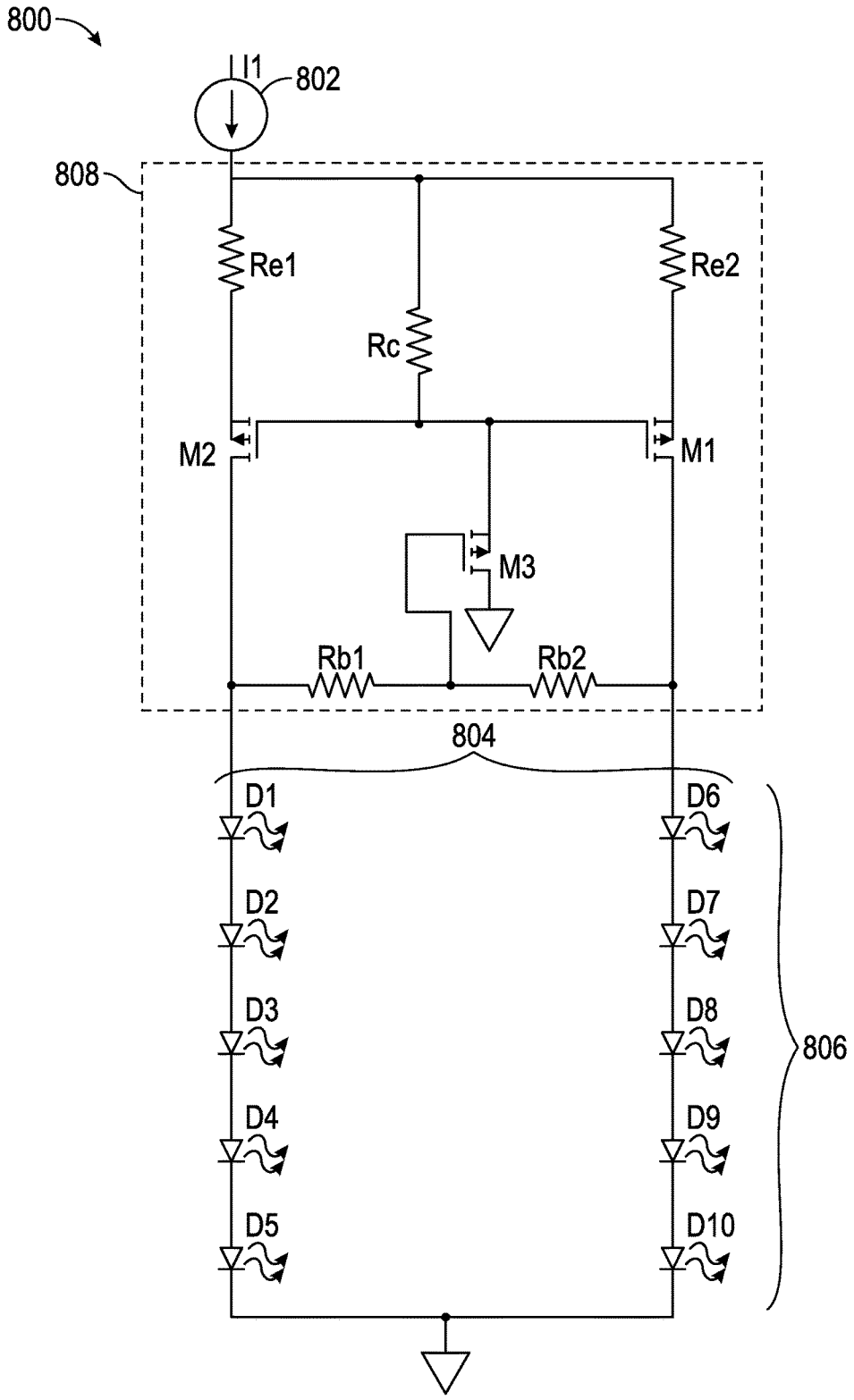
FIG. 8 is another circuit for balancing currents in parallel load paths using Field Effect Transistors (FETs), in accordance with the disclosed embodiments.
Figure 9:
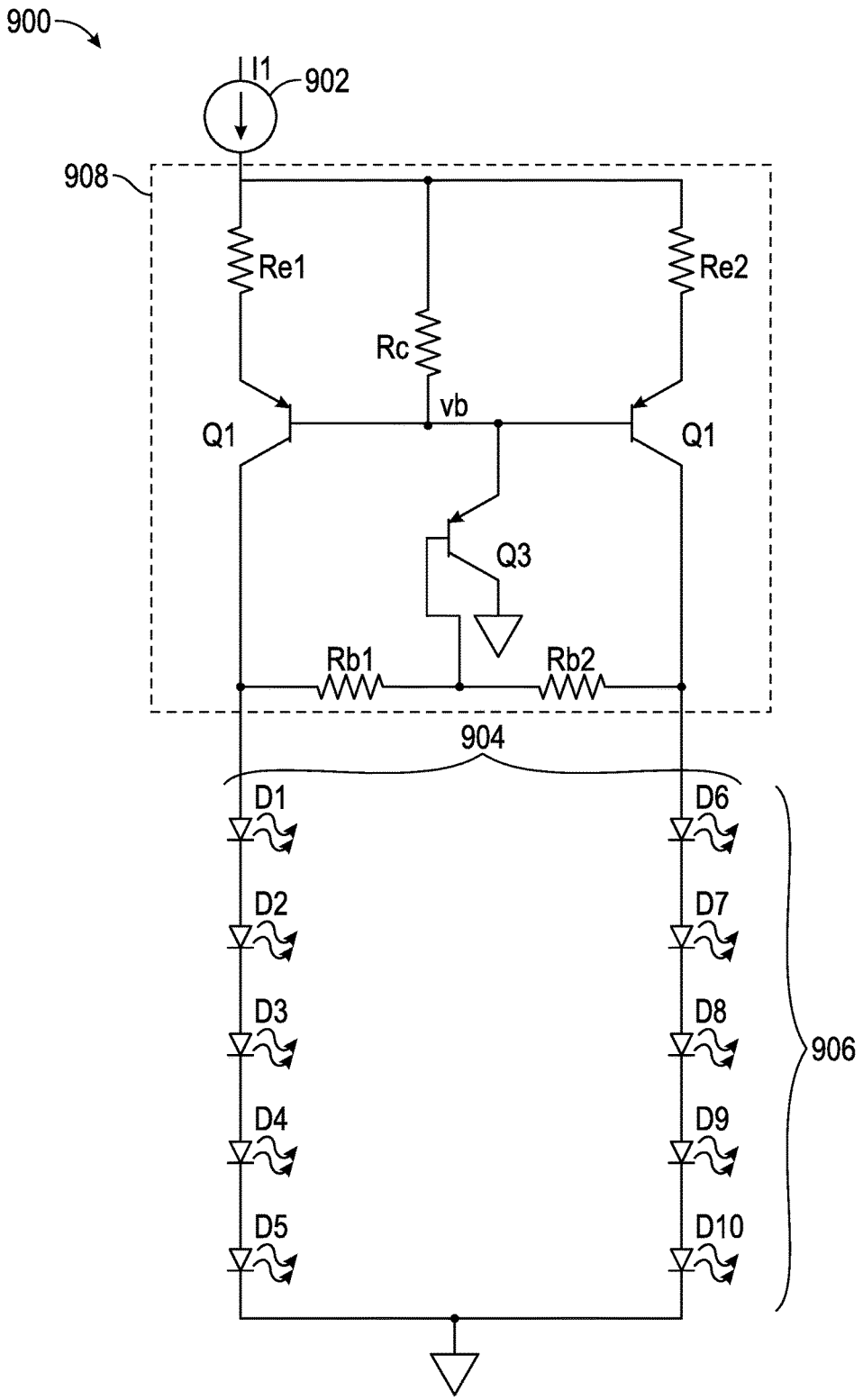
FIG. 9 is a circuit for balancing current in parallel load paths using bipolar transistors, in accordance with the disclosed embodiments.

As shown, the current-balancing circuitry illustrated in FIGS. 5-6 is implemented using NPN bipolar transistors on the low side (or return side or ground side) of the load. However, other embodiments of current-balancing circuitry are illustrated in FIGS. 7-9. For example, FIG. 7 is a circuit 700 for balancing currents in parallel load paths 704 using N-channel Field Effect Transistors (FETs) on the ground side of the load. Here, the N-channel FETs use the same configuration as the NPN bipolar transistors of the enhanced current mirror shown in FIG. 6. However, the N-channel FETs change the operation of the circuit 700 in that the Vgs threshold voltage of the FETs is likely higher than the typical 0.7V Vbe of the bipolar transistors.

As another example, FIG. 8 is a circuit 800 for balancing currents in parallel load paths 804 using P-channel FETs on the high side (or supply side) of the load. Here, the P-channel FETs also use the same configuration as the N-channel FETs of the enhanced current mirror shown in FIG. 7. However, the P-channel FETs change the operation of the circuit 800 in that the circuit is applied to the high voltage side of the load instead of being applied to the low voltage side of the load. As a third example, FIG. 9 is a circuit 900 for balancing currents in parallel load paths 904 using PNP bipolar transistors on the supply side of the load. Here, the PNP bipolar transistors use the same configuration as the NPN bipolar transistors of the enhanced current mirror shown in FIG. 6. However, the PNP bipolar transistors change the operation of the circuit 900 in that the circuit is applied to the high voltage side of the load instead of being applied to the low voltage side of the load.

Although FIGS. 5 and 6 show three parallel loads and FIGS. 7-9 show two parallel loads, it should be noted that any of these configurations could be used for any number of parallel loads, whether there be 2, 3, 4, 5, or more. The same figures also show a plurality of series connected loads. However, the scope is not limited to a certain number of series connected loads. The load may be a single component or a plurality of series connected loads.

Figure 10:
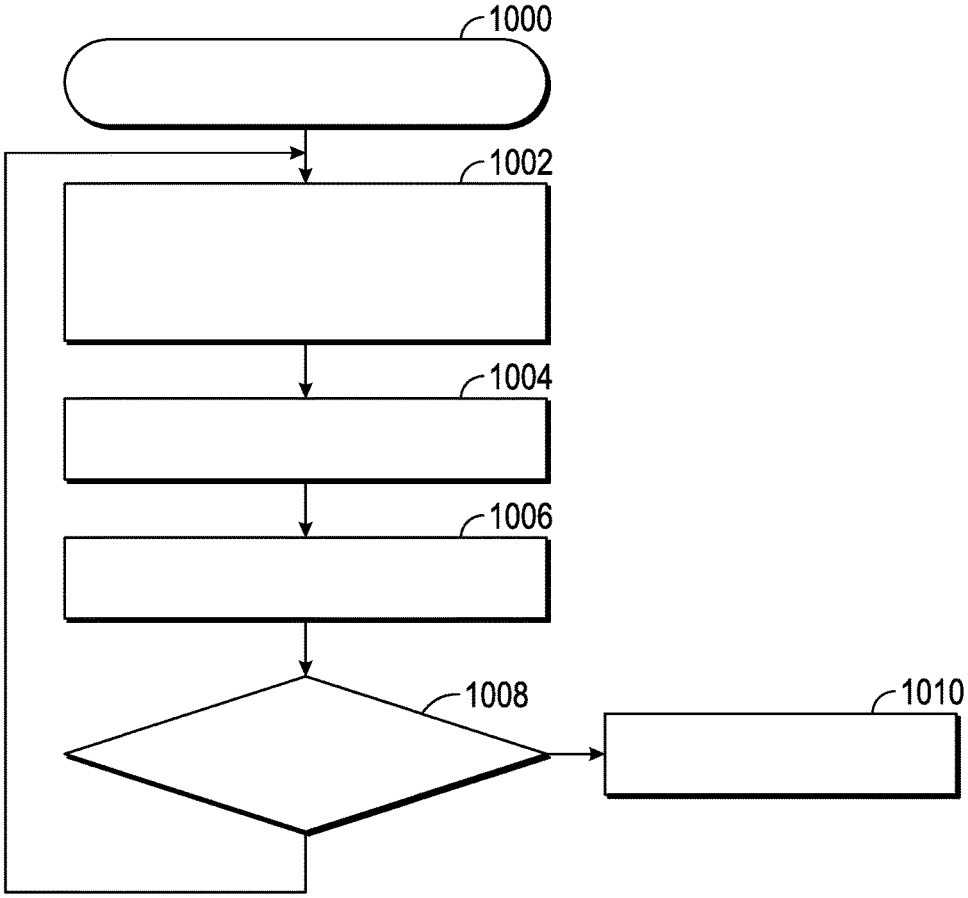
FIG. 10 is a flow chart that illustrates an embodiment of a process for accommodating unbalanced loads in a current-balancing circuit.

FIG. 10 is a flow chart that illustrates an embodiment of an optional process 1000 for accommodating unbalanced loads in a current-balancing circuit. Exemplary embodiments of a current-balancing circuit are illustrated in FIGS. 5-9 above, and will not be redundantly described here. For purposes of the following process 1000, each of the plurality of parallel loads may not be equal, identical, or balanced, thereby producing an excess of power during operation which must be dissipated to prevent transistors in the current-balancing circuit from overheating.

First, the process 1000 identifies a threshold voltage at which performance deterioration of the plurality of transistors occurs (step 1002). This threshold is determined through a comprehensive thermal study to ensure that the transistors are not overstressed during worst case conditions. This would be very application specific, so it is left to the designer to determine the appropriate threshold for a specific application. Factors considered in determining an appropriate threshold may include, without limitation: maximum current flow through the transistor, maximum voltage across the transistor (Vce for bipolar transistors or Vds for FETs), maximum power to be dissipated in the transistor, transistor thermal impedance, circuit board or other thermal impedance, maximum desired operating ambient temperature, and maximum allowed junction temperature of the transistor.

Next, the process 1000 detects a voltage across the plurality of transistors (step 1004), and compares the voltage to the threshold voltage (step 1006). When the voltage exceeds the threshold voltage (the "Yes" branch of 1008), the process 1000 reduces the output of the constant source of current (step 1010). Here, the process 1000 may reduce the amount of current flowing through the plurality of parallel loads by any appropriate amount, up to and including deactivating the current source such that no current flows into the current-balancing circuitry.

The various tasks performed in connection with process 1000 may be performed by software, hardware, firmware, or any combination thereof. For illustrative purposes, the following description of process 1000 may refer to elements mentioned above in connection with FIGS. 1-9. In practice, portions of process 1000 may be performed by different elements of the described system. It should be appreciated that process 1000 may include any number of additional or alternative tasks, the tasks shown in FIG. 10 need not be performed in the illustrated order, and process 1000 may be incorporated into a more comprehensive procedure or process having additional functionality not described in detail herein. Moreover, one or more of the tasks shown in FIG. 10 could be omitted from an embodiment of the process 1000 as long as the intended overall functionality remains intact.

Techniques and technologies may be described herein in terms of functional and/or logical block components, and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processor devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

When implemented in software or firmware, various elements of the systems described herein are essentially the code segments or instructions that perform the various tasks. The program or code segments can be stored in a processor-readable medium or transmitted by a computer data signal embodied in a carrier wave over a transmission medium or communication path. The "computer-readable medium", "processor-readable medium", or "machine-readable medium" may include any medium that can store or transfer information. Examples of the processor-readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, or the like. The computer data signal may include any signal that can propagate over a transmission medium such as electronic network channels, optical fibers, air, electromagnetic paths, or RF links. The code segments may be downloaded via computer networks such as the Internet, an intranet, a LAN, or the like.

For the sake of brevity, conventional techniques related to signal processing, data transmission, signaling, network control, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

Some of the functional units described in this specification have been referred to as "modules" in order to more particularly emphasize their implementation independence. For example, functionality referred to herein as a module may be implemented wholly, or partially, as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices, or the like. Modules may also be implemented in software for execution by various types of processors. An identified module of executable code may, for instance, comprise one or more physical or logical modules of computer instructions that may, for instance, be organized as an object, procedure, or function. Nevertheless, the executables of an identified module need not be physically located together, but may comprise disparate instructions stored in different locations that, when joined logically together, comprise the module and achieve the stated purpose for the module. Indeed, a module of executable code may be a single instruction, or many instructions, and may even be distributed over several different code segments, among different programs, and across several memory devices. Similarly, operational data may be embodied in any suitable form and organized within any suitable type of data structure. The operational data may be collected as a single data set, or may be distributed over different locations including over different storage devices, and may exist, at least partially, merely as electronic signals on a system or network.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A system for balancing current in a circuit, the system comprising:

a plurality of parallel load paths of the circuit, each of the plurality of parallel load paths comprising a single load or a plurality of loads connected in series;

a current source electrically connected to the circuit, the current source configured to provide a constant current to the plurality of parallel load paths, the current comprising the constant current;

a plurality of bipolar transistors, each of the plurality of bipolar transistors electrically connected in series to one of the plurality of parallel load paths, and each of the plurality of bipolar transistors comprising a base, an emitter, and a collector;

a plurality of emitter resistors, each of the plurality of emitter resistors electrically connected to a respective emitter of an associated one of the plurality of bipolar transistors;

a plurality of base resistors, each of the plurality of base resistors electrically connected to a respective one of the plurality of bipolar transistors to create a connection, wherein the connection electrically connects a base and a collector of one of the plurality of bipolar transistors; and a common base node electrically connecting each of the bases of each of the plurality of bipolar transistors.

2. The circuit of claim 1, wherein the current source is further configured to provide the constant current through the plurality of loads and a current mirror comprising the plurality of bipolar transistors, the plurality of emitter resistors, the plurality of base resistors, and the common base node.

3. The circuit of claim 1, wherein each of the plurality of base resistors comprises an equivalent resistance value.

4. The circuit of claim 1, wherein each of the plurality of bipolar transistors is positioned on a ground side of one of the plurality of parallel load paths.

5. The circuit of claim 4, wherein each of the plurality of transistors comprises an NPN bipolar transistor.

6. The circuit of claim 1, wherein each of the plurality of transistors is positioned on a supply side of one of the plurality of parallel load paths.

7. The circuit of claim 6, wherein each of the plurality of transistors comprises a PNP bipolar transistor.

8. The current-balancing circuit of claim 1, wherein the plurality of emitter resistors comprise varied emitter resistance values.

9. The current-balancing circuit of claim 1, wherein the plurality of emitter resistors comprise equivalent emitter resistance values.

10. A current-balancing circuit comprising:

a plurality of parallel load paths electrically connected to a constant source of current, each of the plurality of parallel load paths comprising a single load or a plurality of loads connected in series; and a current mirror configured to balance the current in the plurality of parallel load paths, the current mirror comprising:

a plurality of bipolar transistors, wherein each of the plurality of transistors is electrically connected to a respective one of the plurality of parallel load paths, wherein each of the plurality of transistors comprises a base, an emitter, and a collector, and wherein a plurality of bases of the plurality of transistors is electrically connected to create a common base node;

a plurality of base resistors, each of the plurality of base resistors electrically connecting a collector and a base of a respective one of the plurality of transistors; and a control node, electrically connecting the plurality of base resistors, the control node configured to be driven by an average voltage of the plurality of loads.

11. The current-balancing circuit of claim 10, wherein the current mirror further comprises:

a beta helper transistor, electrically connected to one of the plurality of parallel load paths, electrically connected to the common base node at a beta helper emitter, and electrically connected to the control node at a beta helper base.

12. The current-balancing circuit of claim 11, wherein the control node further comprises the common base node.

13. The current-balancing circuit of claim 10, wherein the current mirror further comprises:

a plurality of emitter resistors, each of the plurality of emitter resistors electrically connected to a respective one of the plurality of transistors at an emitter.

14. The current-balancing circuit of claim 13, wherein the plurality of emitter resistors comprise varied emitter resistance values.

15. The current-balancing circuit of claim 13, wherein the plurality of emitter resistors comprise equivalent emitter resistance values.

16. The current-balancing circuit of claim 10, wherein the current mirror is positioned between a low side of the plurality of loads and circuit ground.

17. The current-balancing circuit of claim 10, wherein the current mirror is positioned between a high side of the plurality of loads and the constant source of current.

18. A current-balancing circuit comprising:

a plurality of parallel load paths electrically connected to a constant source of current, each of the plurality of parallel load paths comprising a single load or a plurality of loads connected in series;

a current mirror configured to balance the current in the plurality of parallel load paths, the current mirror comprising:

a plurality of bipolar transistors, wherein each of the plurality of transistors is electrically connected to a respective one of the plurality of parallel load paths, wherein each of the plurality of transistors comprises a base, an emitter, and a collector, and wherein a plurality of bases of the plurality of transistors is electrically connected to create a common base node;

a plurality of base resistors, each of the plurality of base resistors electrically connecting a collector and a base of a respective one of the plurality of transistors; and a control node, electrically connecting the plurality of base resistors, the control node configured to be driven by an average voltage of the plurality of loads; and at least one processor electrically connected to each of the plurality of parallel loads, the at least one processor configured to:

identify a threshold voltage at which performance deterioration of the plurality of transistors occurs;

detect a voltage across the plurality of transistors;

compare the voltage to the threshold voltage; and when the voltage is greater than the threshold voltage, reduce output of the constant source of current.

19. The current-balancing circuit of claim 18, wherein the current mirror further comprises:

a beta helper transistor, electrically connected to one of the plurality of parallel load paths, electrically connected to the common base node at a beta helper emitter, and electrically connected to the control node at a beta helper base.

20. The current-balancing circuit of claim 19, wherein the control node further comprises the common base node.

* * * * *